US010106973B1

(12) United States Patent
Sarda

(10) Patent No.: US 10,106,973 B1
(45) Date of Patent: Oct. 23, 2018

(54) PRECAST CONCRETE BUILDING ELEMENTS AND ASSEMBLIES THEREOF, AND RELATED METHODS

(71) Applicant: Nandy Sarda, Las Vegas, NV (US)

(72) Inventor: Nandy Sarda, Las Vegas, NV (US)

( * ) Notice: Subject to any disclaimer, the term of this patent is extended or adjusted under 35 U.S.C. 154(b) by 0 days.

(21) Appl. No.: 15/890,877

(22) Filed: Feb. 7, 2018

Related U.S. Application Data

(62) Division of application No. 15/474,306, filed on Mar. 30, 2017.

(51) Int. Cl.

| | |
|---|---|
| ***E04B 1/21*** | (2006.01) |
| ***E04C 5/06*** | (2006.01) |
| ***E04C 3/34*** | (2006.01) |
| ***E04H 12/16*** | (2006.01) |

(52) U.S. Cl.
CPC ..... *E04B 1/21* (2013.01); *E04C 3/34* (2013.01); *E04C 5/0627* (2013.01); *E04H 12/16* (2013.01)

(58) Field of Classification Search
CPC . E04B 1/21; E04C 5/0627; E04C 3/34; E04H 12/16
USPC ..... 52/252, 258, 259
See application file for complete search history.

(56) References Cited

U.S. PATENT DOCUMENTS 2,420,427 A * 5/1947 Henderson ..... E04B 1/21 52/283
3,354,593 A * 11/1967 Zukas ..... E04B 1/21 52/125.1
3,383,816 A * 5/1968 Hodson ..... E04B 5/43 52/263
3,594,971 A * 7/1971 Hughes ..... E04B 1/215 52/236.7
3,613,325 A * 10/1971 Yee ..... E04B 1/20 52/236.8
3,867,805 A * 2/1975 Mikami ..... E04B 1/215 52/252

(Continued)

FOREIGN PATENT DOCUMENTS

| | | |
|---|---|---|
| CN | 10342260 | 12/2013 |
| GB | 1038881 | 8/1996 |
| JP | 2015209634 | 11/2015 |

OTHER PUBLICATIONS

PCT International Searching Authority; International Search Report and Written Opinion dated Oct. 12, 2017; entire document.

*Primary Examiner* — Joshua K Ihezie
(74) *Attorney, Agent, or Firm* — Allen Dyer Doppelt & Gilchrist PA

(57) ABSTRACT

An assembly of concrete structural elements includes a precast concrete lower column, a precast concrete column capital supported on an upper end of the lower column, at least one precast concrete beam supported by the precast column capital, at least one slab supported by the at least one beam, an upper column extending above the lower column, and a poured concrete lap splice connecting the lower and upper columns, a volume of the lap splice being at least partially defined by the lower column, the column capital, the beam, the slab and the upper column. A method of making a lap splice comprises embedding splice reinforcement in each of opposed end of a pair of concrete structural elements such that the splice reinforcement extends out of each approximately as far as the structural reinforcement and overlaps the structural reinforcement within the opposed ends.

10 Claims, 7 Drawing Sheets

(56) References Cited

U.S. PATENT DOCUMENTS 4,081,935 A * 4/1978 Wise ..... E04B 1/21 52/236.8
4,398,378 A * 8/1983 Heitzman ..... E04B 5/04 52/251
4,443,985 A * 4/1984 Moreno ..... E04B 5/43 52/236.8
5,123,220 A * 6/1992 Simenoff ..... E04B 1/22 52/236.8
5,161,340 A * 11/1992 Wetton ..... E04B 1/21 52/236.7
5,195,293 A * 3/1993 diGirolamo ..... E04B 1/24 52/745.13
5,366,672 A * 11/1994 Albrigo ..... B28B 23/043 264/219
5,367,854 A * 11/1994 Kim ..... E04G 21/06 264/426
5,371,990 A * 12/1994 Salahuddin ..... E04B 1/163 52/379
5,390,464 A * 2/1995 West ..... E04B 5/43 52/741.1
5,392,580 A * 2/1995 Baumann ..... B21F 27/125 52/646
5,507,124 A * 4/1996 Tadros ..... E04B 5/43 52/251
5,678,375 A * 10/1997 Juola ..... E04B 1/24 52/236.7
5,809,712 A * 9/1998 Simanjuntak ..... E04C 5/08 52/223.7
6,625,943 B1 * 9/2003 Renner ..... E04B 1/165 52/250
6,920,728 B2 * 7/2005 Powers ..... E04B 1/22 52/236.5
8,011,147 B2 * 9/2011 Hanlan ..... E04B 1/20 52/236.3
8,671,634 B2 * 3/2014 Morcous ..... E04B 5/16 52/252
9,404,254 B2 * 8/2016 Reigstad ..... E04B 5/32
2004/0045241 A1 * 3/2004 Guillebeau ..... E02D 27/42 52/378
2004/0177574 A1 * 9/2004 Wallin ..... E04B 1/20 52/252
2008/0060293 A1 * 3/2008 Hanlon ..... E04B 1/20 52/251
2009/0077925 A1 * 3/2009 McMullen ..... E04C 3/32 52/834
2010/0024332 A1 * 2/2010 Valaire ..... E04B 5/38 52/252
2011/0002744 A1 * 1/2011 Tadros ..... E02D 5/523 405/232
2016/0032580 A1 * 2/2016 Rahimzadeh ..... E04B 1/30 52/236.9
2017/0051495 A1 * 2/2017 Zavitz ..... E04C 3/34

* cited by examiner

PRECAST CONCRETE BUILDING ELEMENTS AND ASSEMBLIES THEREOF, AND RELATED METHODS

CROSS-REFERENCE TO RELATED APPLICATION

This application is a divisional of U.S. patent application Ser. No. 15/474,306, filed on Mar. 30, 2017, the contents of which are herein incorporated by reference in their entirety.

FIELD OF THE INVENTION

The present invention relates to precast concrete building elements, such as precast concrete columns, and more particularly, to assemblies made from such building elements and related methods of assembly.

BACKGROUND

The use of reinforced concrete for structural elements of buildings is well known. The loads in concrete structures are transferred by both the concrete and the reinforcement within the structural elements. For many building applications, formwork for the concrete is assembled in situ, reinforcement is placed (typically in the form of steel rebar, often pre-stressed), and the concrete is poured and allowed to cure.

Alternately, precast concrete building elements are sometimes used, with the reinforcement already located therein and often extending out from one or more surfaces thereof. The use of precast elements can offer several advantages, including simplifying and speeding construction, reducing susceptibility to weather and environmental conditions on site, affording greater consistency and quality control for precast elements made in a more controlled, factory setting, etc. Examples of the advantageous use of precast concrete structural elements can be found in the inventor's prior U.S. Pat. No. 4,505,087, the contents of which are herein incorporated by reference in their entirety.

A conventional downside of the precast building elements is the complexity that can be involved when structurally tying one such element into other structural elements. Often, the reinforcement from adjacent elements are bolted or welded together, which can be very time consuming, require highly skilled laborers and special equipment. Sometimes the connection problem is largely avoided in low-rise structures by al the precast elements tall enough for the full height of the structure.

Referring to FIG. 9, a lap splice 170 can be used to tie adjacent elements together, such as upper and lower precast columns 114, 124. The lap splice does not require reinforcement to be bolted or welded together, but simply to overlap for a predetermined splice length 176 in the space between the precast elements, which space is subsequently filled with concrete that cures around the splice 170 and holds the precast elements 114, 124 together.

While this appears, on the face of it, to be a rather simple solution, the problem is that engineering concerns and code requirements will often require a splice length 176 so considerable that it becomes impractical to accommodate the space needed between the precast elements 114, 124. Although the particular equations used to calculate the required splice length can be rather complex, a good approximation for illustrative purposes is that the splice length must be 40 times the diameter of reinforcement for splices in tension and 30 times the diameter of reinforcement for splices in compression.

SUMMARY OF THE INVENTION

In view of the foregoing, it is an object of the present invention to provide improved precast concrete building elements, assemblies thereof and related methods.

According to an embodiment of the present invention, an assembly of concrete structural elements includes a precast concrete lower column, a precast concrete column capital supported on an upper end of the lower column, at least one precast concrete beam supported by the precast column capital, at least one slab supported by the at least one beam, an upper column extending above the lower column, and a poured concrete lap splice connecting the lower and upper columns, a volume of the lap splice being at least partially defined by the lower column, the column capital, the beam, the slab and the upper column.

According to a method aspect, a lap splice is made between opposed ends of adjacent concrete structural elements having structural reinforcement extending therethrough and out the opposed ends thereof. The method comprises embedding splice reinforcement in each of the opposed ends such that the splice reinforcement extends out of each approximately as far as the structural reinforcement and overlaps the structural reinforcement within the opposed ends, and bringing the structural elements together such that the ends of the structural reinforcement and the splice reinforcement extending from the opposed ends overlap.

These and other objects, aspects and advantages of the present invention will be better appreciated in view of the drawings and following detailed description of preferred embodiments.

DETAILED DESCRIPTION OF PREFERRED EMBODIMENTS

Figure 1:
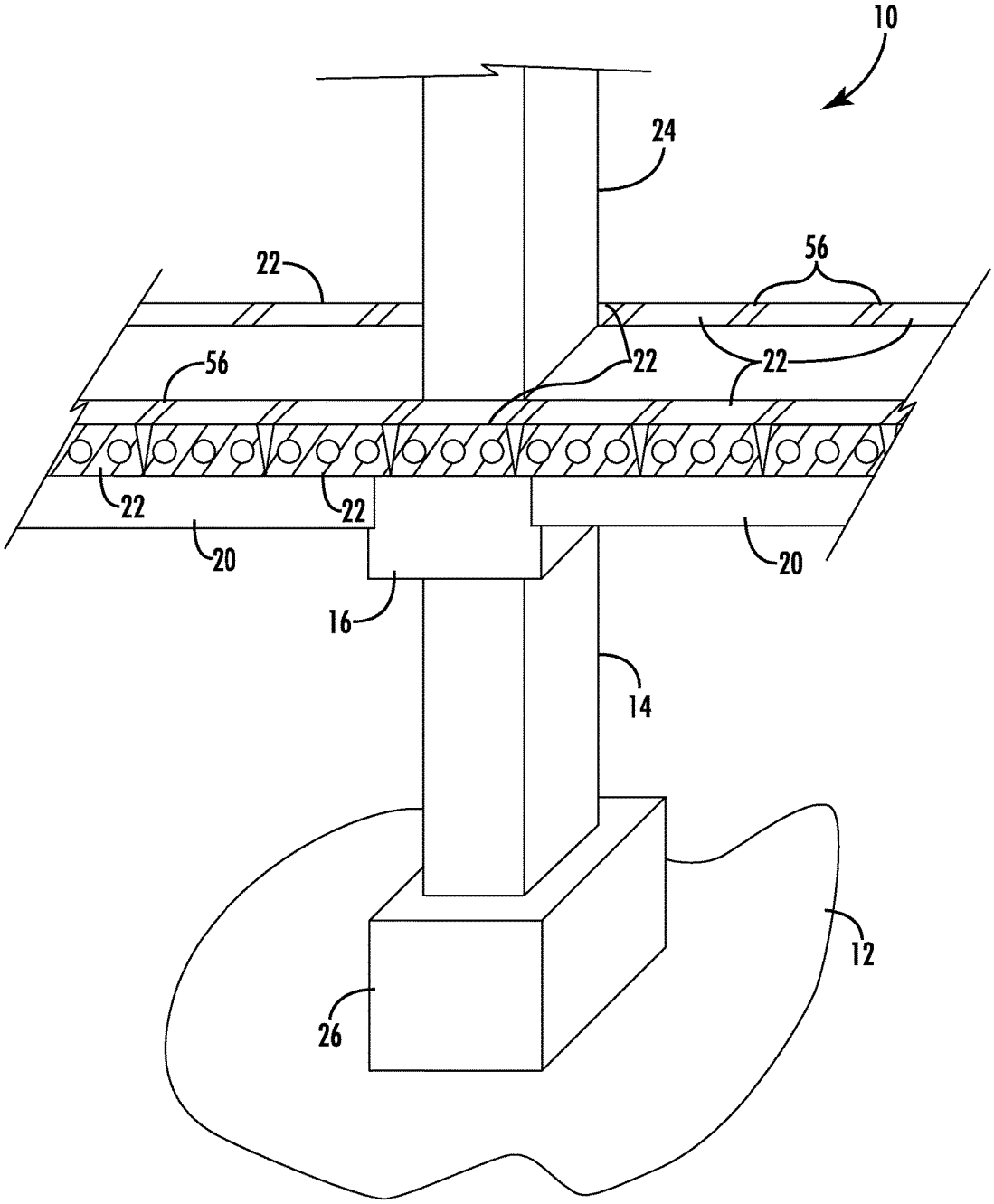
FIG. 1 is a partial perspective view of an assembly of precast concrete structural elements according to an embodiment of the present invention, including upper and lower precast columns, a precast column capital, precast beams, and precast slabs (in section), the assembly being tied to a foundation slab and poured column footing.

According to an embodiment of the present invention, referring to FIG. 1, an assembly 10 of precast concrete structural elements is connected to and extends away from a poured slab 12, or other suitable surface. The precast concrete structural elements are generally concrete with reinforcement, such as steel rebar, extending therethrough.

The precast concrete structural elements include a lower column 14, a column capital 16, beams 20, slabs 22 and upper column 24. A poured footing 26 supports a lower end of the lower column 14. With reference to FIG. 2-8, the assembly of the structural elements, and further features thereof, will be described. These structural elements are selected for exemplary and illustrative purposes, and it will be appreciated the present invention is not necessarily limited thereto.

Figure 2:
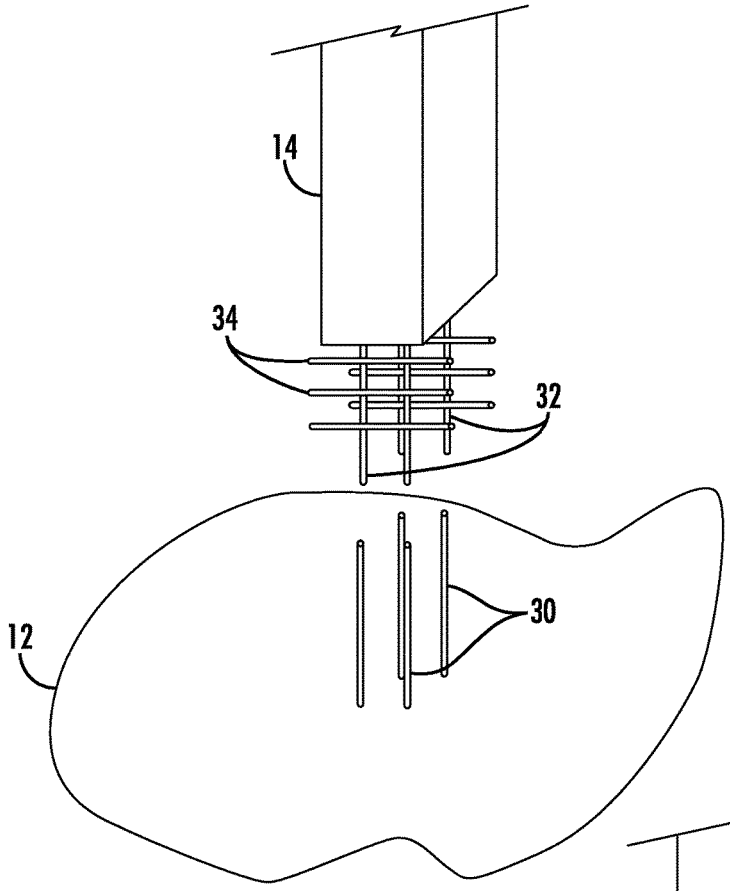
FIG. 2 is a partial perspective view of the lower precast column of FIG. 1 being located over the foundation slab.
Figure 3:
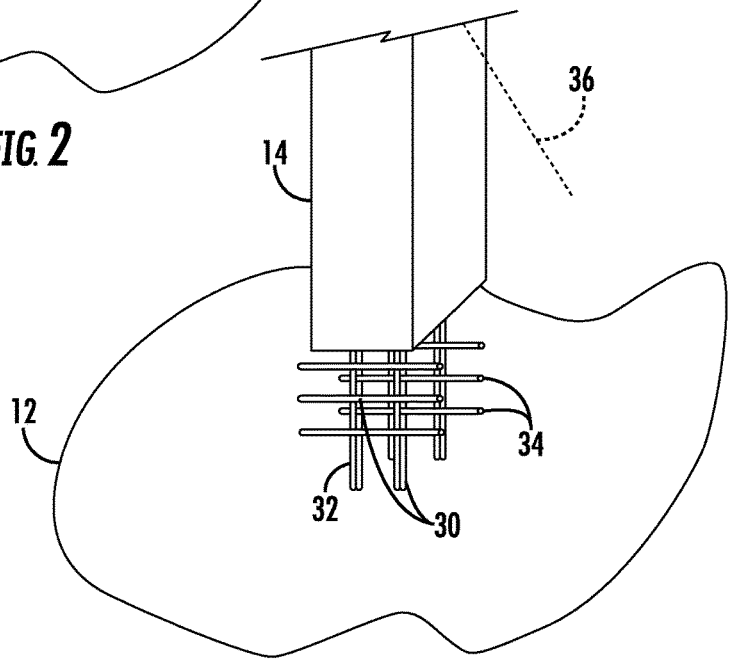
FIG. 3 is a partial perspective view of the lower precast column of FIG. 1 situated over the foundation slab, optional alternate components being shown in broken lines.

Referring to FIG. 2, reinforcement 30 extends upwardly from the slab 12 or other surface where the lower column 14 is to be situated. The lower column 14 is arranged over the slab 12, with column reinforcement 32 facing downward toward the slab reinforcement 30. Further reinforcement, in the form of column ties 34 extend generally perpendicular to the column reinforcement 30. Referring to FIG. 3, the lower column 14 is lowered to sit above the slab 12 with the column reinforcing 32 and the slab reinforcing overlapping. Bracing 36 can be applied as necessary to steady the lower column 14 while pouring the footing 26.

Figure 4:
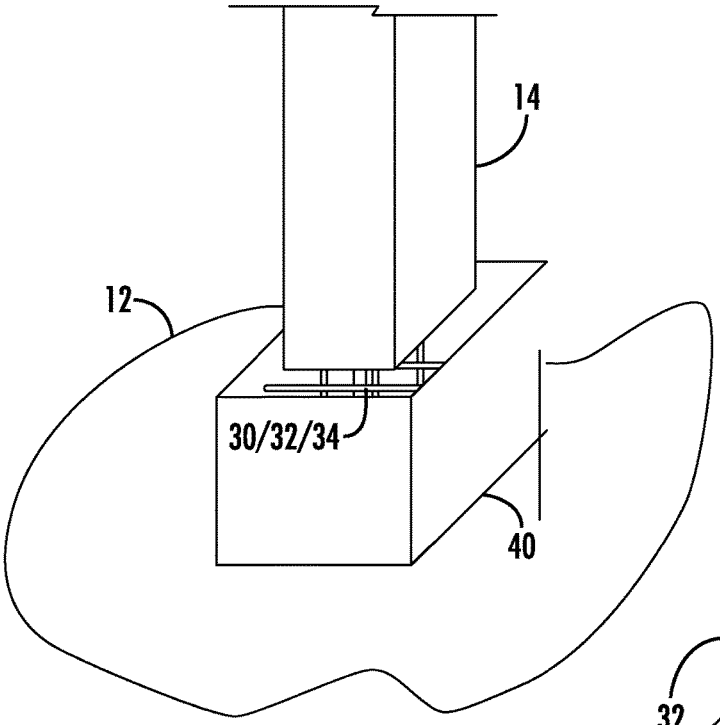
FIG. 4 is a partial perspective view of the lower precast column of FIG. 1 situated over the foundation slab with formwork for the column footing arranged thereabout.
Figure 5:
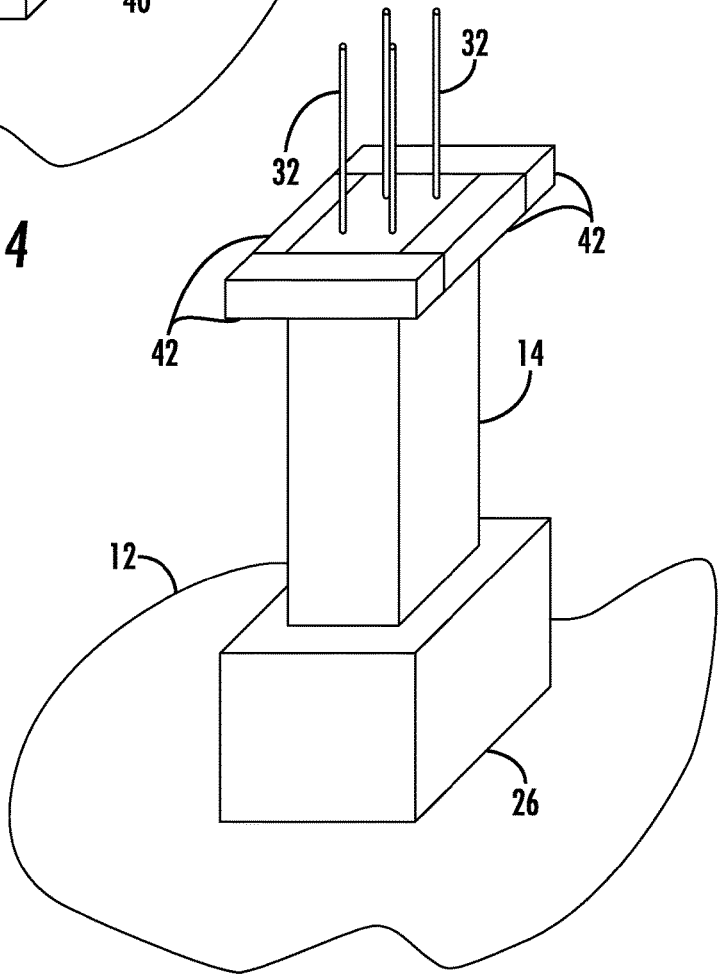
FIG. 5 is a partial perspective view of the lower precast column of FIG. 1, with temporary supports for the precast column capital attached.

Referring to FIG. 4, formwork 40 for the footing 26 is arranged around the overlapping reinforcement elements 32, 34, 36. Referring to FIG. 5, the footing 26 is poured, supporting the lower column 14 and tying it structurally to the slab 12.

To support the column capital 16 before it is permanently tied to the lower column 14 and the rest of the assembly 10, support blocks 42 are glued or otherwise secured around an upper end of the lower column 14. The support blocks 42 can be made of polystyrene or other suitable material. When no longer needed, the support blocks 42 can be removed, or alternately, left in place with some finish applied thereto. To facilitate visibility, the support blocks 42 are shown extending to the edges of the column capital 16; however, this is not a design requirement. The support blocks 42 can be much smaller than the footprint of the column capital 16. Strengthening the holding power of the support blocks 42 can be performed by wrapping cellophane or other substance acting as a belt around them.

Figure 6:
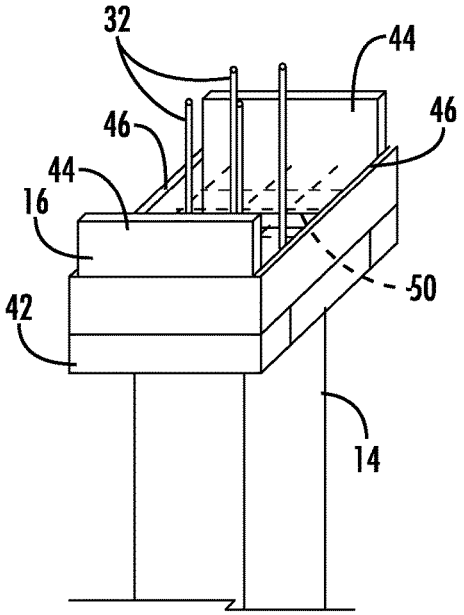
FIG. 6 is a partial perspective view of the lower precast column of FIG. 1, with the precast column capital in place, optional alternate components being shown in broken lines.

Referring to FIG. 6, the column capital 16 is placed on the support blocks 42 at the upper end of the lower column 14 with upper ends of the column reinforcement 32 extending upwardly therethrough. The column capital 16 includes end walls 44 and notched side walls 46 where the beams 20 are to be arranged. Other configurations of column capital 16 walls could be used to support different numbers and arrangements of beams. The column capital 16 can include reinforcement 50 therein as necessary to facilitate a structural tie with the lower column 14.

Figure 7:
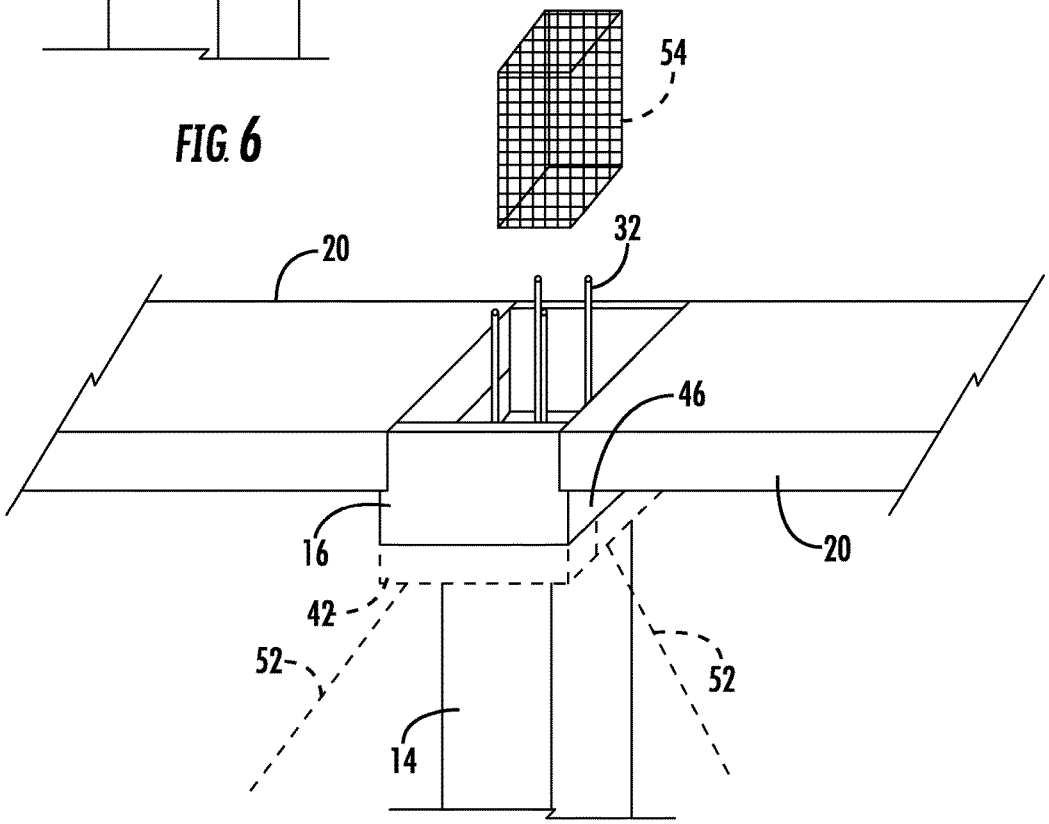
FIG. 7 is a partial perspective view of the lower precast column and precast column capital of FIG. 1, with the precast beams in place.

Referring to FIG. 7, the beams 20 are placed on the notched side walls 46 of the column capital 16. To ensure that the column capital 16 can support the weight of the beams 20, bracing 52 can be added to the support blocks 42. Alternately, the interior of column capital 16 could be partially poured before placing the beams 20, in which case a wire screen 54 or the like is placed around the column reinforcement 32 to ensure the region thereabout remains temporarily free of concrete.

Figure 8:
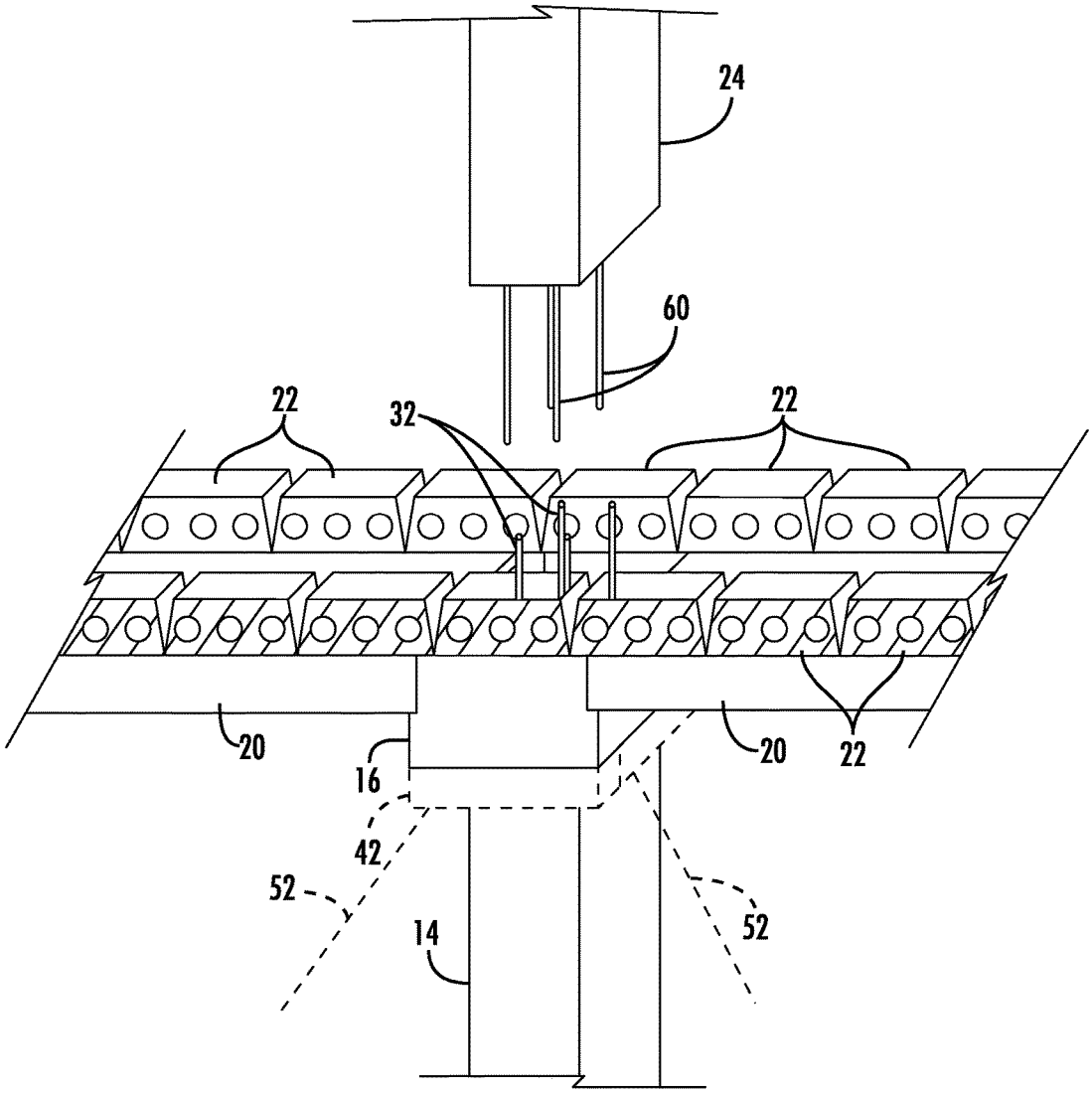
FIG. 8 is a partial perspective view of the lower precast column, precast column capital and precast beams of FIG. 1, with the precast slabs (in section) arranged thereon and the upper precast column located thereabove.
Figure 9:
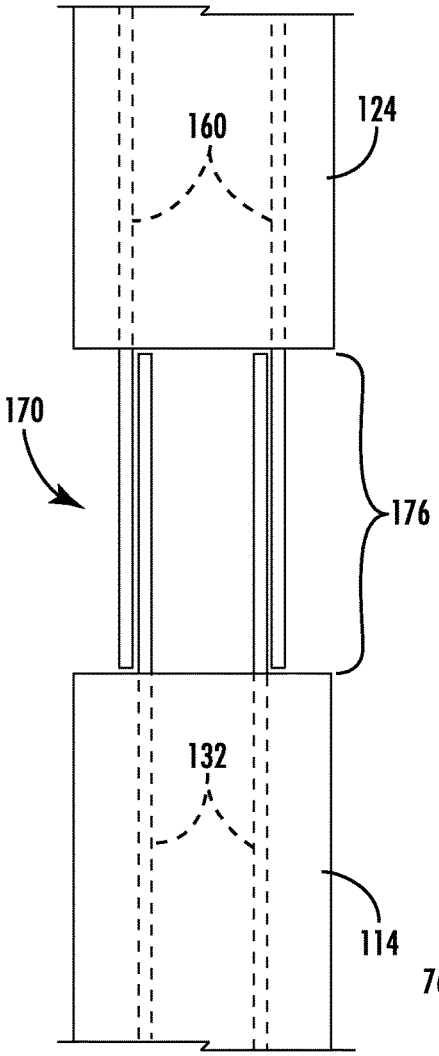
FIG. 9 (PRIOR ART)
FIG. 9 is a schematic side view of a lap splice between upper and lower precast elements, hidden components being shown in broken lines.

Referring to FIG. 8, the slabs 22 are placed on the beams 20, with the upper ends of the reinforcement 32 of the lower column 14 being left clear. Grout 56 (see FIG. 1), with reinforcement as required, can be poured between the slabs 22. The depicted slabs 22 are precast hollow core slabs; however, any suitable precast or cast-in-place slab(s) could be used.

The upper column 24 is arranged above the lower column 14, with upper column reinforcing 60 extending downwardly therefrom. From the foregoing, it will be appreciated that the lower column 14, column capital 16, beams 20 and slabs 22 both offer support for the upper column 24 and serve as a form for the space that needs to be poured to complete a lap splice between the respective reinforcement 32, 60. Thus, little or no additional formwork need be added, and the upper column 24 need only be lowered into the location shown in FIG. 1 and the empty volume bounded by the structural elements poured to tie the entire assembly 10 together.

Figure 10:
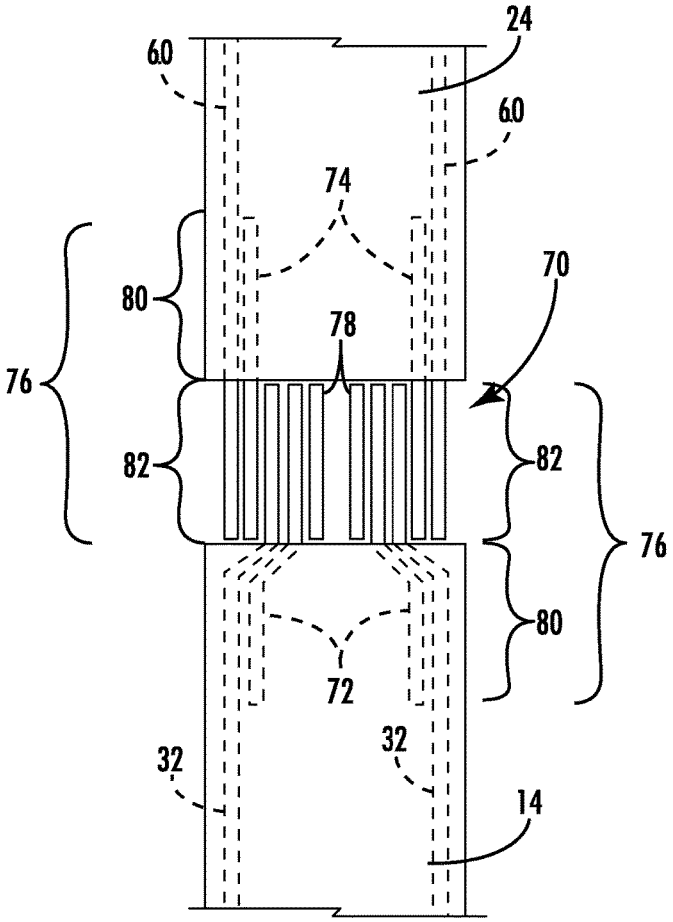
FIG. 10 is a schematic side view of a shortened lap splice between upper and lower precast elements, hidden components being shown in broken lines, according to an aspect of the present invention.

For clarity of the illustrations, the reinforcement 32, 60 of the upper and lower columns 14, 24 is not shown in detail and every reinforcement element is not necessarily shown. Referring to FIG. 10, a lap splice 70 between the lower and upper columns 14, 24 will be explained in detail. In addition to the column reinforcing 32, 60, the lap splice 70 is formed from splice reinforcement 72, 74 extending from the lower and upper columns 14, 24, respectively.

Each element of splice reinforcement 72, 74 overlaps its respective column reinforcement 32, 60 by the entire required splice length 76. Approximately one-half 80 of the overlap is within the respective column 14, 24, and one-half 82 of the overlap is outside. Thus, the effective exposed distance over which the column reinforcement 32, 60 and splice reinforcement 72, 74 is approximately one-half the full required splice length 76. An approximately 50% reduction in the required spacing for the lap splice 70 is achieved. Further reductions could be achieved by using larger diameter rebar for the splice reinforcement 72, 74 and/or by employing additional, shorter splice reinforcement sections 78 in the space 82 between the columns 14, 16. Preferably, an element of splice reinforcement 72, 74, 78 is supplied for each element of column reinforcement 32, 60.

The substantial reduction in effective lap splice 70 length achieved by the present invention can work synergistically with the assembly 10. In particular, the height of the column capital 16, beams 20 and/or slabs 22 can readily be adjusted to closely match the effective lap splice 70 length, making tying together of structural elements via a lap splice much simpler.

Figure 11:
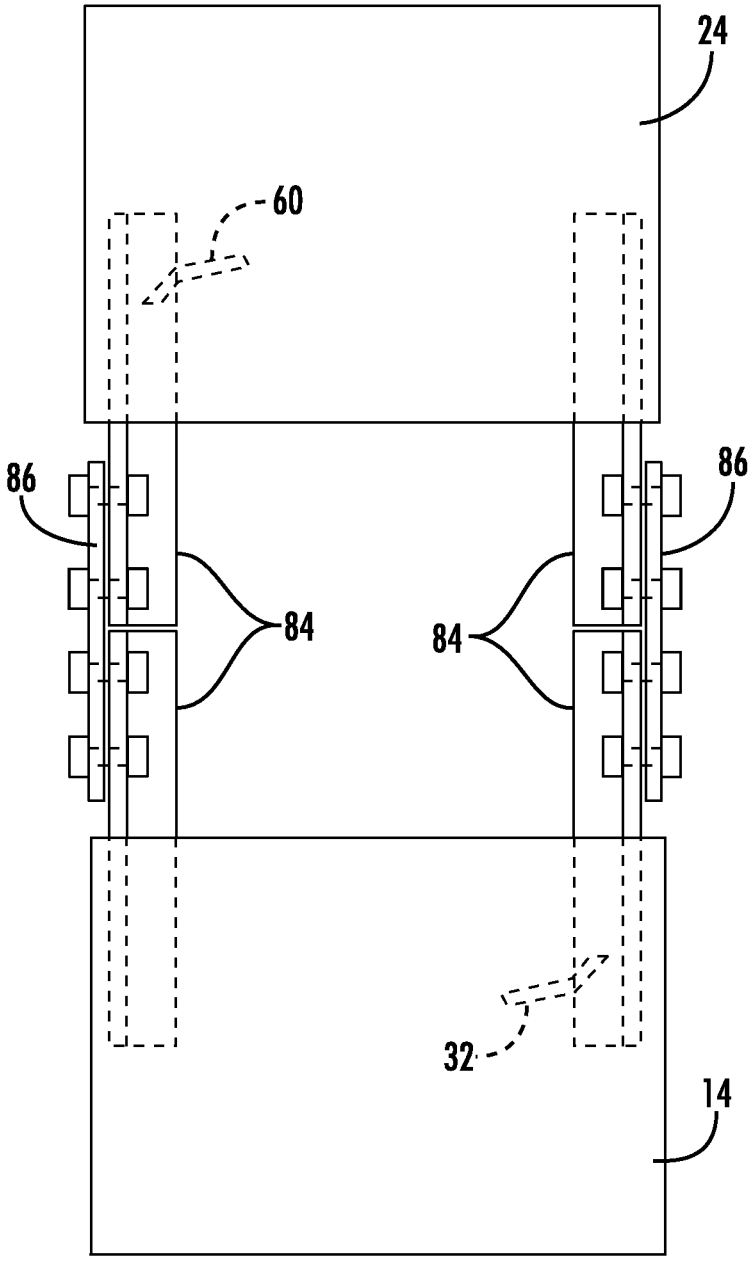
FIG. 11 is a schematic side view of a stabilizing connection between upper and lower precast elements, hidden components being shown in broken lines, according to a further aspect of the present invention.

While the present invention can significantly reduce the required splice length, and allow other structural elements to serve as formwork for the lap splice, it may still be desirable to provide additional stability to the upper column 24 while the lap splice 70 is being poured. Referring to FIG. 11, generally opposed stabilizing connectors 84 extend from respective ends of the lower and upper columns 14, 24. Each pair of stabilizing connectors 84 is connected by a splice bar 86 that is bolted or otherwise secured to the connectors 84. The stabilizing connectors 84 are preferably made from steel angles or similarly strong and rigid material partially embedded into the columns 14, 24.

Only two pairs of connectors 84 are shown in FIG. 11 (without the other reinforcement for clarity of illustration), although more or fewer pairs could be used. The stabilizing connectors 84 enhance the immobility of the upper column 24 before and during pouring of the lap splice 70, ensuring accurate final alignment and placement of the upper column 24. Additionally, the connectors 84 could supplement or replace the splice reinforcement 72, 74 for some applications.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. An assembly method for concrete structural elements, the method comprising:

embedding lap splice reinforcement in a first concrete column such that a first portion of the lap splice reinforcement overlaps with reinforcements of the first concrete column, and a second portion of the lap splice reinforcement extends out of an upper end of the first concrete column;

embedding lap splice reinforcement in a second concrete column such that a first portion of the lap splice reinforcement overlaps with reinforcements of the second concrete column, and a second portion of the lap splice reinforcement extends out of an end of the second concrete column;

arranging a precast concrete column capital defining an interior volume on the upper end of the first concrete column such that the second portion of the lap splice reinforcement extending from the first column extends into the interior volume of the column capital;

arranging the second concrete column over the first concrete column and the column capital such that the second portion of the lap splice reinforcement extending from the second column extends into the interior volume of the column capital and overlaps therein with the second portion of the lap splice reinforcement extending from the first column;

supporting at least one precast concrete beam on an edge of the column capital; and pouring the interior volume of the column capital with concrete.

2. The method of claim 1, further comprising attaching support blocks around the upper end of the first column prior to arranging the column capital thereon, the support blocks supporting the column capital.

3. The method of claim 2, wherein the support blocks are adhered to the first column.

4. The method of claim 2, wherein the support blocks are polystyrene.

5. The method of claim 2, wherein the support blocks are braced before supporting the beam on the edge of the column capital and the pouring of the interior volume of the column capital is performed after supporting the beam on the edge thereof.

6. The method of claim 1, wherein a portion of the pouring of the interior volume of the column capital is performed before supporting the beam on the edge thereof.

7. A method of making a lap splice between opposed ends of adjacent concrete structural elements having structural reinforcement extending therethrough and out the opposed ends thereof, the method comprising:

embedding first portions of lap splice reinforcement in each of the opposed ends such that second portions of the lap splice reinforcement extend out of each end approximately as far as the structural reinforcement and the first portions overlap the structural reinforcement within the opposed ends;

bringing the structural elements together adjacent opposite sides of a column capital defining an interior volume such that the ends of the structural reinforcement and the second portions of the lap splice reinforcement extending from the respective opposed ends overlap within the interior volume; and pouring concrete into the interior volume between the opposed ends of the adjacent concrete structural elements.

8. The method of claim 7, wherein a length of overlap between the first portions of the lap splice reinforcement and structural reinforcement embedded in the opposed ends is approximately equal to a length overlap of the second portions of the lap splice reinforcement within the interior volume of the column capital.

9. The method of claim 7, further comprising arranging additional splice reinforcement within the overlap of the structural reinforcement and second portions of the lap splice reinforcement between the opposed ends.

10. The method of claim 9, wherein a length of the additional splice reinforcement is approximately equal to a length overlap of the second portion of the lap splice reinforcement.

* * * * *